US007782275B2

(12) United States Patent
Kim et al.

(10) Patent No.: US 7,782,275 B2
(45) Date of Patent: Aug. 24, 2010

(54) ORGANIC LIGHT EMITTING DISPLAY AND DRIVING METHOD THEREOF

(75) Inventors: Yang Wan Kim, Seoul (KR); Komiya Naoaki, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1299 days.

(21) Appl. No.: 11/291,919

(22) Filed: Dec. 2, 2005

(65) Prior Publication Data

US 2006/0151745 A1 Jul. 13, 2006

(30) Foreign Application Priority Data

Dec. 8, 2004 (KR) ..... 10-2004-102818

(51) Int. Cl.
*G09G 3/30* (2006.01)

(52) U.S. Cl. ..... 345/76

(58) Field of Classification Search ..... 345/76–83
See application file for complete search history.

(56) References Cited

U.S. PATENT DOCUMENTS 7,277,071 B2 * 10/2007 Oh ..... 345/76
2003/0179164 A1 * 9/2003 Shin et al. ..... 345/76
2004/0150599 A1 8/2004 Morita

FOREIGN PATENT DOCUMENTS

JP 2001-67047 3/2001
JP 2004-138778 5/2004

* cited by examiner

*Primary Examiner*—Alexander Eisen
*Assistant Examiner*—Robin Mishler
(74) *Attorney, Agent, or Firm*—H.C. Park & Associates, PLC

(57) ABSTRACT

Disclosed is an organic light emitting display and a driving method thereof capable of reducing the number of output lines in a data driver. A scan driver sequentially supplies a scan signal to a scan line during a second period of one horizontal period. A data driver includes a plurality of output lines, for supplying a plurality of data signals to the respective output lines during the second period. Demultiplexers are installed at the respective output lines, and include a plurality of data transistors for supplying the data signals to the output lines during the second period, to a plurality of data lines. Initializing sections are installed between a first initialization power supply and the plurality of data lines, and include a plurality of initialization transistors for supplying a voltage of the first initialization power supply to the plurality of data lines. A pixel portion includes a plurality of pixels positioned at areas partitioned by the scan line and the data lines, and the initialization transistors are turned-on during a first period of the one horizontal period, which is not overlapped with the second period.

10 Claims, 13 Drawing Sheets

ORGANIC LIGHT EMITTING DISPLAY AND DRIVING METHOD THEREOF

CROSS-REFERENCE TO RELATED APPLICATIONS

This application claims the benefit of Korean Patent Application No. 10-2004-102818, filed on Dec. 8, 2004, in the Korean Intellectual Property Office, the disclosure of which is incorporated herein by reference, in its entirety.

BACKGROUND

1. Field of the Invention

The invention relates to an organic light emitting display and a driving method thereof, and more particular to an organic light emitting display and a driving method thereof, which may reduce the number of output lines in a data driver.

2. Discussion of Related Art

Recently, various flat panel displays (FPD) capable of reducing weight and volume that are disadvantages of cathode ray tubes (CRT) have been developed. The FPDs include liquid crystal displays (LCD), field emission displays (FED), plasma display panels (PDP), and organic light emitting displays (OLED).

An organic light emitting display among flat display devices, displays an image using an organic light emitting diode that generates light by the recombination of electrons and holes. Such an organic light emitting display has advantages in that it has a high response speed, and operates in a low power consumption.

FIG. 1 is a view showing a conventional organic light emitting display. With reference to FIG. 1, the conventional organic light emitting display includes a pixel portion 30, a scan driver 10, a data driver 20, and a timing controller 50. The pixel portion 30 includes a plurality of pixels 40 formed at a crossing area of scan lines S1 to Sn and data lines D1 to Dm. The scan driver 10 drives the scan lines S1 to Sn. The data driver 20 drives the data lines D1 to Dm. The timing controller 50 controls the scan driver 10 and the data driver 20.

The scan driver 10 generates a scan signal in response to a scan drive control signal SCS from the timing controller 50, and sequentially provides the generated scan signal to the scan lines S1 to Sn. The scan driver 10 generates a light emitting control signal in response to the scan drive control signal SCS from the timing controller 50, and sequentially provides the generated light emitting control signal to the light emitting control lines E1 to En.

The data driver 20 receives the data drive control signal DCS from the timing controller 50. Upon the receipt of the data drive control signal DCS, the data driver 20 generates data signals, and provides the generated data signals to the data lines D1 to Dm. Here, the data driver 20 provides the generated data signals to the data lines D1 to Dm every horizontal period.

The timing controller 50 generates a data drive control signal DCS and a scan drive control signal SCS according to externally supplied synchronous signals. The data drive control signal DCS generated by the timing controller 50 is provided to the data driver 20, and the scan drive control signal SCS is provided to the scan driver 10. Furthermore, the timing controller 50 provides externally supplied data "Data" to the data driver 20.

The pixel portion 30 receives a first power supply ELVDD and a second power supply ELVSS from an exterior source, and provides them to respective pixels 40. Upon the receipt of the first power supply ELVDD and the second power supply ELVSS, the pixels 40 control the amount of a current into the second power supply ELVSS from the first power supply ELVDD through a organic light emitting diode corresponding to the data signal, thus generating light corresponding to the data signal. Furthermore, light emitting times of the pixels 40 are controlled by the light emitting control signals.

In the conventional organic light emitting display having the driving method, each of the pixels 40 is positioned at a crossing part of the scan lines S1 to Sn and the data lines D1 to Dm. Here, the data driver 20 includes m output lines for supplying a data signal to m data lines D1 to Dm. That is, in the conventional organic light emitting display, the data driver 20 include output lines as the same number of the data lines D1 to Dm. Accordingly, at least one data driving circuit is included inside of the data driver 20 in order to have m output lines therein, thereby incurring an increase in manufacturing cost. More particularly, as a resolution and a size of the pixel portion 30 are increased, the data driver 20 needs more output lines, thereby causing manufacturing cost to be increased.

SUMMARY OF THE INVENTION

Accordingly, it is an aspect of the present invention to provide an organic light emitting display and a driving method thereof capable of reducing the number of output lines in a data driver.

The foregoing and/or other aspects of the present invention are achieved by providing organic light emitting display that includes: a scan driver for sequentially supplying a scan signal to a scan line during a second period of one horizontal period; a data driver including a plurality of output lines, for supplying a plurality of data signals to the respective output lines during the second period; demultiplexers installed at the respective output lines, and including a plurality of data transistors for supplying the data signals to the output lines during the second period, to a plurality of data lines; initializing sections installed between a first initialization power supply and the plurality of data lines, and including a plurality of initialization transistors for supplying a voltage of the first initialization power supply to the plurality of data lines; and a pixel portion including a plurality of pixels positioned at areas partitioned by the scan line and the data lines, where the initialization transistors are turned-on during a first period of the one horizontal period, which is not overlapped with the second period.

According to a second aspect of the present invention, there is provided a method for driving a organic light emitting display, the method comprising the steps of: supplying a first initialization power to a plurality of data lines during a first period of one horizontal period; supplying a plurality of data signals to respective output lines during a second period of the one horizontal period; and supplying the plurality of data signals supplied to the respective output lines during the second period, to the plurality of data lines.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE INVENTION

Figure 1:
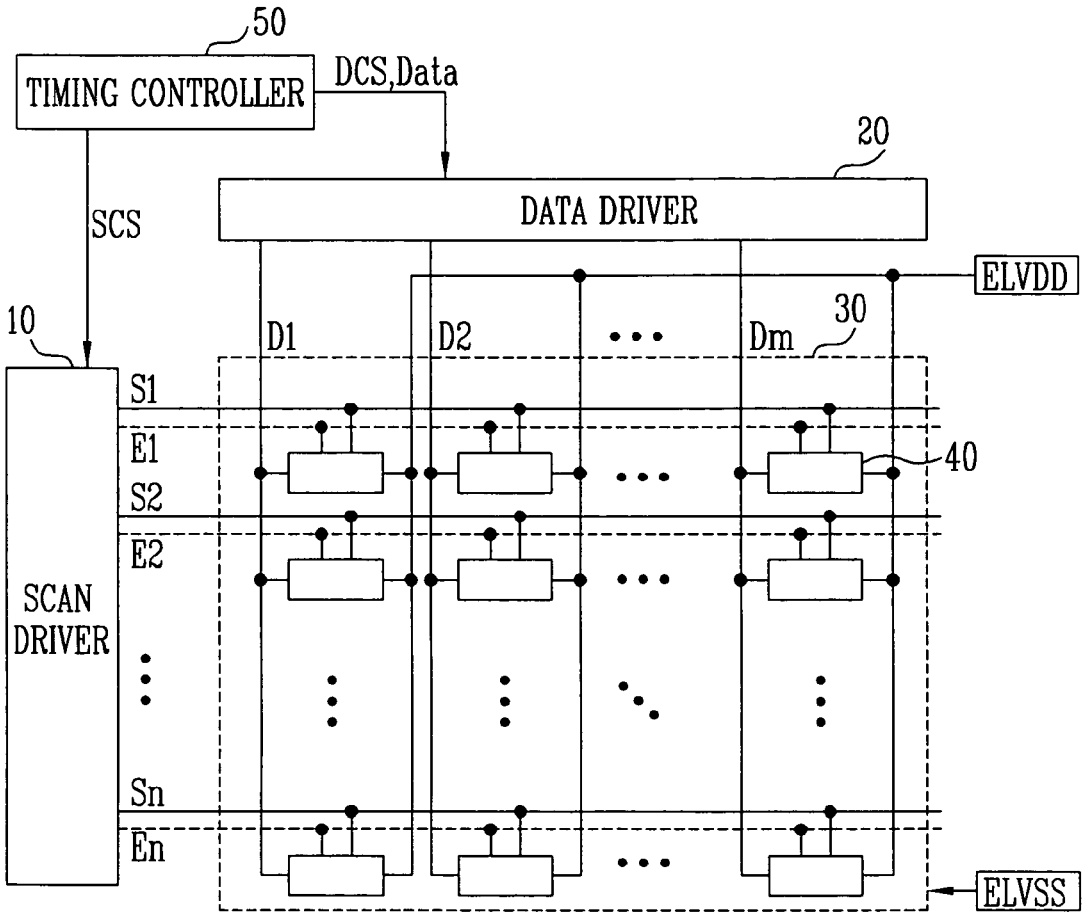
FIG. 1 (PRIOR ART)
FIG. 1 is a view showing a conventional organic light emitting display.

Hereinafter, various embodiments according to the invention will be described with reference to the accompanying drawings. Here, when one element is connected to another element, one element may be not only directly connected to another element but also indirectly connected to another element via another element. Further, irrelevant elements are omitted for clarity. Also, like reference numerals refer to like elements throughout.

Figure 2:
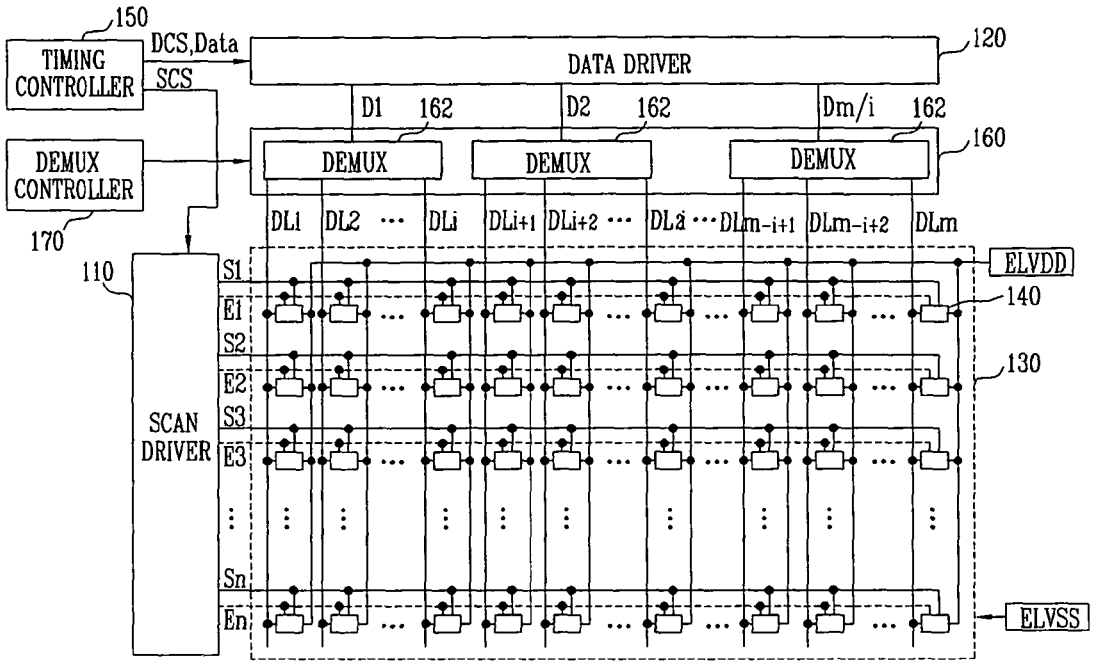
FIG. 2 is a view showing a organic light emitting display according to a first embodiment of the invention.

FIG. 2 is a view showing an organic light emitting display according to a first embodiment of the invention. With reference to FIG. 2, the organic light emitting display according to a first embodiment of the present invention includes a scan driver 110, a data driver 120, a pixel portion 130, a timing controller 150, a demultiplexer block 160, and a demultiplexer controller 170.

The pixel portion 130 includes a plurality of pixels 140 positioned at areas partitioned by scan lines S1 to Sn and second data lines DL1 to DLm. Each of the pixels 140 generates light corresponding to a data signal supplied from the second data line DL.

The scan driver 110 generates a scan signal in response to scan control signals SCS supplied from the timing controller 150, and sequentially supplies the generated scan signal to the scan lines S1 to Sn. Furthermore, the scan driver 110 generates a light emitting control signal responsive to the scan drive control signals SCS, and sequentially provides the generated light emitting control signal to light control lines E1 to En.

The data driver 120 generates data signals responsive to data drive control signals DCS supplied from the timing controller 150, and provides the generated data signals to first data lines D1 to Dm/i. Here, the first data lines D1 to Dm/i are respectively installed to every output line of the data driver 120, and the data driver 120 provides i (where i is a natural number greater than 2) data signals to the first data lines D1 to Dm/i every supply period (one horizontal period) of the scan signal.

The timing controller 150 generates data drive control signals DCS and scan drive control signals SCS according to externally supplied synchronous signals. The data drive control signals DCS and the scan drive control signals SCS generated by the timing controller 150 are provided to the data driver 120 and the scan driver 110, respectively. Moreover, the timing controller 150 provides externally supplied data "Data" to the data driver 120.

The demultiplexer block 160 includes m/i demultiplexers 162. In other words, the demultiplexer block 160 includes the same number of demultiplexers 162 as the number of the first data lines D1 to Dm/i, and the demultiplexers 162 are coupled with the first data lines D1 to Dm/i, respectively.

In addition, each of the demultiplexers 162 is coupled with i second data lines DL. Such a demultiplexer 162 sequentially provides i data signals supplied to the first data line D every horizontal period to i second data lines DL. That is, the demultiplexer 162 provides a data signal supplied to a first data line D to the i second data lines DL. When the data signal is supplied to a first data line D and the i second data lines DL, the number of output lines included in the data driver 120 is rapidly reduced. For example, assuming that "i" is 3, the number of is output lines included in the data driver 120 is reduced by ⅓ when compared with the number of conventional output lines. Accordingly, the number of data driving circuits included in the data driver 120 is also reduced. Namely, the invention has an advantage in that manufacturing costs may be reduced because a data signal supplied to a one first data line D is provided to the i second data lines DL using the demultiplexer 162.

The demultiplexer controller 170 provides i control signals to the demultiplexers 162 every horizontal period, respectively. That is, the demultiplexer controller 170 provides i control signals that allows a data signal supplied to a first data line D to be supplied to the i second data lines DL. Here, although the demultiplexer controller 170 is provided external to the timing controller 150, the demultiplexer controller 170 may be provided internal to the timing controller 150 in another embodiment of the invention.

Figure 3:
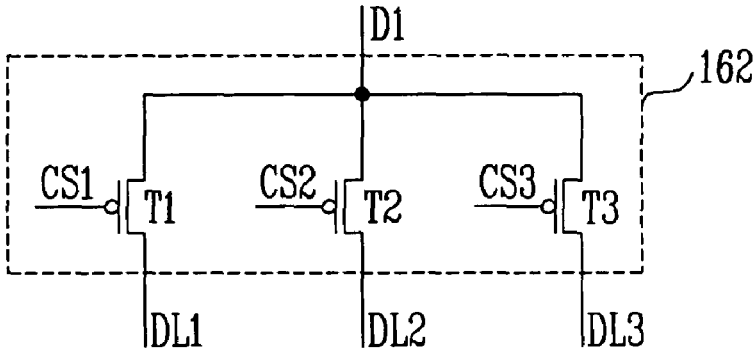
FIG. 3 is a circuitry diagram showing a demultiplexer shown in FIG. 2.

FIG. 3 is a circuitry diagram showing a demultiplexer as shown in FIG. 2. It is assumed that "i" is 3 in order to help the understanding of the embodiment of the invention. Further, it is assumed that the demultiplexer shown in FIG. 3 is the demultiplexer that is coupled with the first data line D1.

Referring to FIG. 3, the demultiplexers 162 each includes a first switch (or transistor T1), a second switch T2, and a third switch T3.

The first switch T1 is installed between a first data line D1 and a second data line DL1, and provides the data signal as supplied to the first data line D1 to the second data line DL1. The first switch T1 is driven by a first control signal CS1 as supplied from the demultiplexer controller 170.

The second switch T2 is installed between the first data line D1 and the second data line DL2, and provides the data signal as supplied to the first data line D1 to the second data is line DL2. The second switch T2 is driven by a second control signal CS2 as supplied from the demultiplexer controller 170.

The third switch T3 is installed between the first data line D1 and a second data line DL3, and provides the data signal as supplied to the first data line D1 to the second data line DL3. The third switch T3 is driven by a third control signal CS3 as supplied from the demultiplexer controller 170.

A detailed operation of the demultiplexer 170 will now be described in conjunction with a construction of pixel 140.

Figure 4:
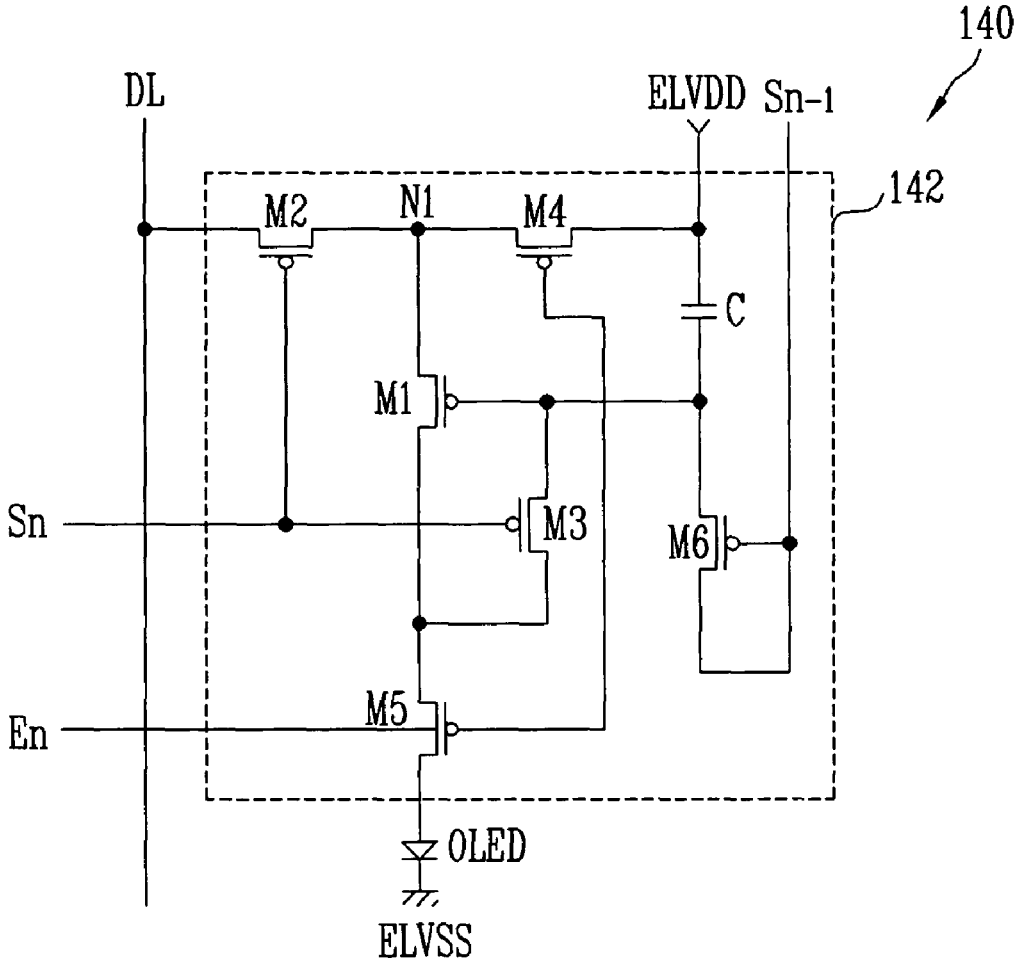
FIG. 4 is a circuitry diagram showing a first example of the pixel shown in FIG. 2.

FIG. 4 is a circuitry diagram showing a first example of the pixel shown in FIG. 2. Substantially, pixels 140 having a construction that receives an initialization voltage prior to applying the data signal in the invention are all applicable to the invention. Here, at least one transistor among a plurality of transistors included in each of the pixels 140 is coupled to be used as a diode.

With reference to FIG. 4, pixels 140 according to a first embodiment of the invention each include a pixel circuit 142 coupled with a organic light emitting diode OLED, a second data line DL, a scan line Sn, and a light emitting control line En for emitting light of the organic light emitting diode OLED.

Anode electrode of the organic light emitting diode OLED is coupled with the pixel circuit 142, and a cathode electrode thereof is coupled with a second power supply ELVSS. The second power supply ELVSS has a voltage lower than that of the first power supply ELVDD. For instance, the voltage of the second power supply ELVSS may be a ground voltage. The organic light emitting diode OLED generates light corresponding to a current supplied from the pixel circuit 142.

The pixel circuit 142 includes a storage capacitor C, a first transistor M1, a second transistor M2, a third transistor M3, a fourth transistor M4, a fifth transistor M5, and a sixth transistor M6. The storage capacitor C and the sixth transistor M6 are coupled between the first power supply ELVDD and the $n-1^{th}$ scan line, Sn−1. The fifth transistor M5 is coupled between the organic light emitting diode OLED and the light emitting control line En. The first transistor M1 is coupled between the fifth transistor M5 and a first node N1. The third transistor M3 is coupled between a gate electrode and a second electrode of the first transistor M1. Although it is shown that the first to sixth transistors M1 to M6 are of a P type MOSFET, the invention is not limited thereto with other types of transistors being possible.

A first electrode of the first transistor M1 is coupled with the first node N1, and a second electrode thereof is coupled with a first electrode of the fifth transistor M5. Moreover, a gate electrode of the first transistor M1 is coupled to the storage capacitor C. Here, the first electrode means one of a source electrode and a drain electrode, the second electrode means another electrode. In other words, when the first electrode is set as the source electrode, the second electrode is set as the drain electrode. The first transistor M1 provides a current corresponding to a voltage charged in the storage capacitor C to the organic light emitting diode OLED.

A first electrode of the third transistor M3 is coupled with the second electrode of the first transistor M1, and a second electrode thereof is coupled with a gate electrode of the first transistor M1. Further, a gate electrode of the third transistor M3 is coupled with the n-th scan line Sn. When the scan signal is supplied to the n-th scan line Sn, the third transistor M3 is turned-on, thereby causing the first transistor M1 to be diode-connected. That is, when the third transistor M3 is turned-on, the first transistor M1 is diode-connected.

A first electrode of the second transistor M2 is coupled to the secondary data line DL, and a second electrode thereof is coupled to the first node N1. Moreover, a gate electrode of the second transistor M2 is coupled to the n-th scan line Sn. When the scan signal is provided to the n-th scan line Sn, the second transistor M2 is turned-on, thereby providing the data signal from the second data line DL to the first node N1.

A first electrode of the fourth transistor M4 is coupled with the first power supply ELVDD, and a second electrode thereof is coupled with the first node N1. Furthermore, a gate electrode of the fourth transistor M4 is coupled with the light emitting control line En. When a light emitting control signal is not supplied, the fourth transistor M4 is turned-on to electrically connect the first node N1 to the first power supply ELVDD.

A first electrode of the fifth transistor M5 is coupled with the second electrode of the first transistor M1, and a second electrode thereof is coupled to the organic light emitting diode OLED. In addition, a gate electrode of the fifth transistor M5 is coupled with the light emitting control line En. When the light emitting control signal is not provided, the fifth transistor M5 is turned-on, thus providing a current from the first transistor M1 to the organic light emitting diode OLED.

A first electrode of the sixth transistor M6 is coupled with the storage capacitor C, a second electrode and a gate electrode thereof are coupled to the $n-1^{th}$ scan line Sn−1. When the scan signal is supplied to the $n-1^{th}$ scan line Sn−1, the sixth transistor M6 is turned-on, thereby initializing the storage capacitor C and the gate of the first transistor M1.

Figure 5:
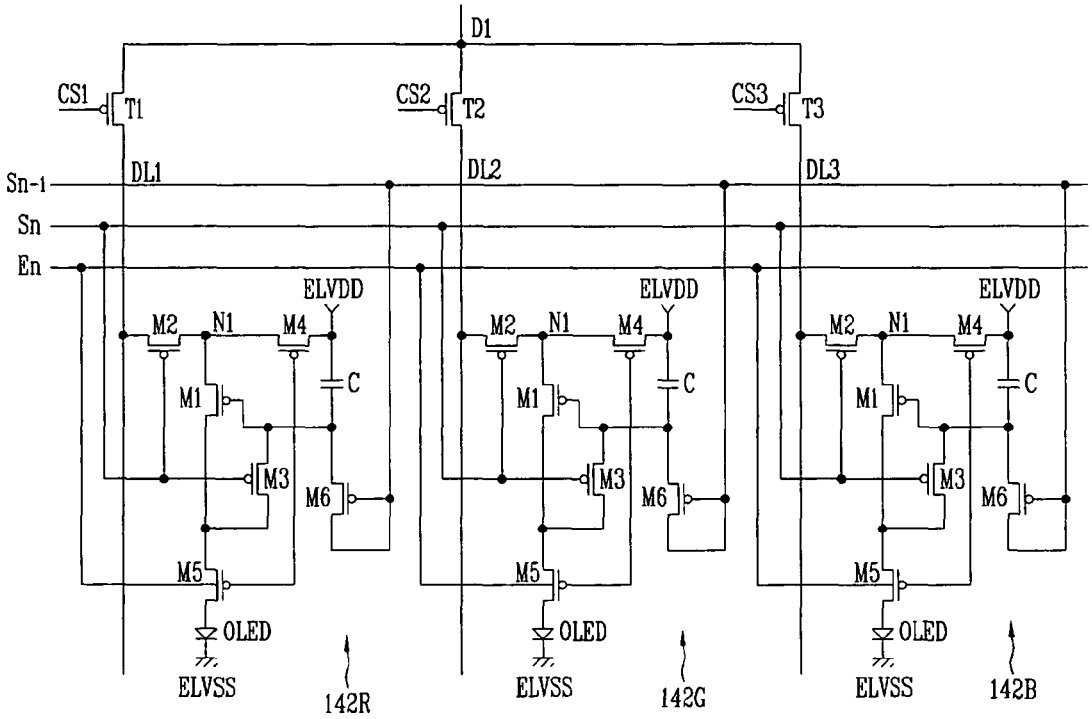
FIG. 5 is a circuitry diagram showing a connected example of the demultiplexer and the pixel shown in FIG. 3 and FIG. 4, respectively.
Figure 6:
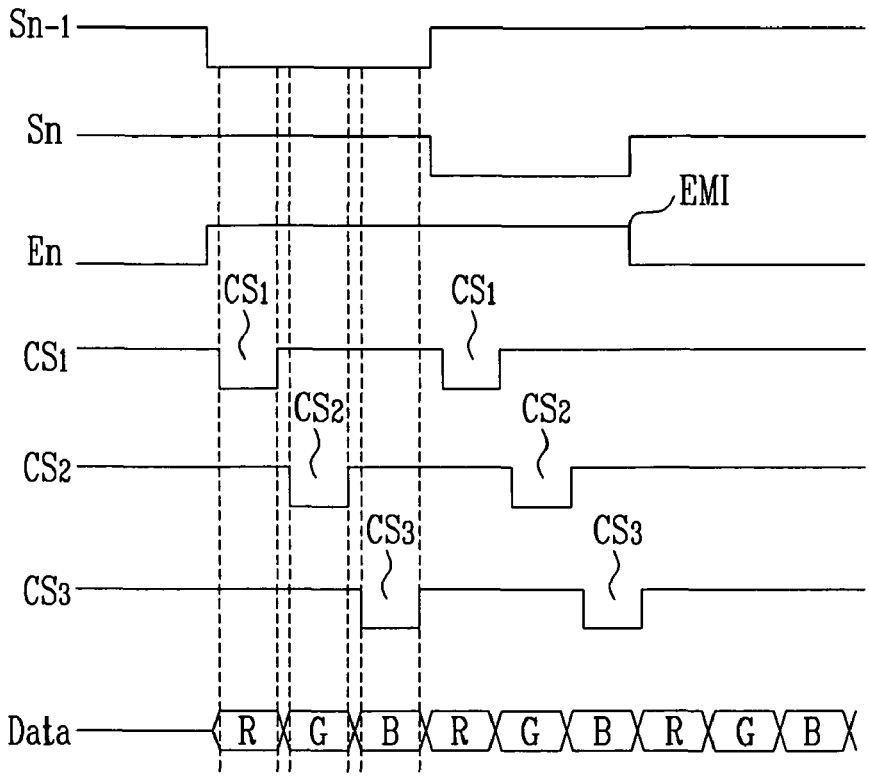
FIG. 6 is a waveform chart of signals that are supplied to the demultiplexer and the pixel shown in FIG. 5.

FIG. 5 is a circuitry diagram showing a connected example of the demulitplexer and the pixel shown in FIG. 3 and FIG. 4, respectively. Here, it is assumed that red (R), green (G), and blue (B) pixels are coupled with one demultiplexer (namely, i=3). FIG. 6 is a waveform chart of signals that are supplied to the demulitplexer and the pixel shown in FIG. 5.

Referring to FIG. 5 and FIG. 6, when the scan signal is supplied to the $(n-1)^{th}$ scan line Sn−1, the sixth transistor M6 included in each of the pixels 142R, 142G, and 142B is turned-on. As the sixth transistor M6 is turned-on, the storage capacitor C and the gate electrode of the first transistor M1 are coupled with the $(n-1)^{th}$ scan line Sn−1. That is, when the sixth transistor M6 is turned-on, the storage capacitor C and the gate electrode of the first transistor M1 change to a voltage value of the scan signal. Here, the scan signal has a voltage value lower than that of the data signal.

Next, the scan signal is supplied to the n-th scan line Sn. As the scan signal is supplied to the n-th scan line Sn, the second transistor M2 and the third transistor M3 included in each of the pixels 142R, 142G, and 142B are all turned-on. After the second transistor M2 and the third transistor M3 are turned-on, the first switch T1 is turned-on by a first control signal CS1.

When the first switch T1 is turned-on, the data signal supplied to the first primary data line D1 is provided to the first node N1 of a first pixel 142R via the first switch T1. At this time, because a gate electrode of the first transistor M1 is initialized by the scan signal supplied to the $(n-1)^{th}$ scan line Sn−1 (that is, the gate electrode of the first transistor M1 is set lower than a voltage of the data signal to the first node N1), the first transistor M1 is turned-on. When the first transistor M1 is turned-on, the data signal applied to the first node N1 is provided to one side of the storage capacitor C through the first transistor M1 and the third transistor M3. At this time, a data signal and a voltage corresponding to a threshold voltage of the first transistor M1 are charged in the storage capacitor C.

Next, after the first switch T1 is turned-off, the second transistor T2 and the third is switch T3 are sequentially turned-on, so that the data signal is sequentially applied to the second pixel 142G and the third pixel 142B. Namely, the invention has an advantage in that it can supply the data signal supplied to a first data line D1 to i second data lines DL using the demultiplexer 162. However, the organic light emitting display according to the first embodiment of the invention has a potential concern in which the data signal might not be supplied to special pixels 142. This concern is addressed below.

This will be described with reference to FIG. 5 in detail. First, as mentioned previously, during a turning-on period of the first switch T1, a voltage corresponding to the data signal is charged in a storage capacitor C of the first pixel 142R. Here, during the turning-on periods of the first switch T1, the second transistor M2 and the third transistor M3 of the second pixel 142G and the second transistor M2 and third transistor M3 of the third pixel 142B maintain a turned-on state by the scan signal supplied to the n-th scan line Sn.

When the second transistor M2 and the third transistor M3 of the second pixel 142G maintain a turned-on state, the gate electrode of the first transistor M1 is electrically connected to the second data line DL2. Here, the second data line DL2 maintains a voltage value of a data signal supplied during a previous period (previous field or frame) by a parasitic capacitor and the like. Accordingly, a voltage value of the gate electrode of the first transistor M1 is changed to a voltage value of the data signal supplied at the previous period. That is, the voltage value initialized by the scan signal supplied to the $(n-1)^{th}$ scan line Sn−1 is changed to the voltage value of the data signal supplied during the previous period.

Then, the second switch T2 is turned-on by the second control signal CS2. When the second switch T2 is turned-on, the data signal supplied to the first data line D1 is provided to the second data line DL2. Next, the data signal provided to the second data line DL2 is supplied to the first node N1 through the second transistor M2 of the second pixel 142G. Here, the first node N1 is set as a voltage value corresponding to a current data signal, whereas the gate electrode of the first transistor M1 is set as a voltage value of a previous data signal. Where the voltage value supplied to the first node N1 is greater than a sum of the voltage value of the previous data signal and the threshold voltage of the first transistor M1, the first transistor M1 is turned-on, whereas the first transistor M1 is turned-off in the remaining cases.

That is, in the first embodiment of the invention, upon driving the demultiplexer 162, because a voltage value of the gate electrode of each of the first transistors M1 included in the second pixel 142G and the third pixel 142B is varied, a potential problem may occur in displaying a desired image, which is addressed below.

Figure 7:
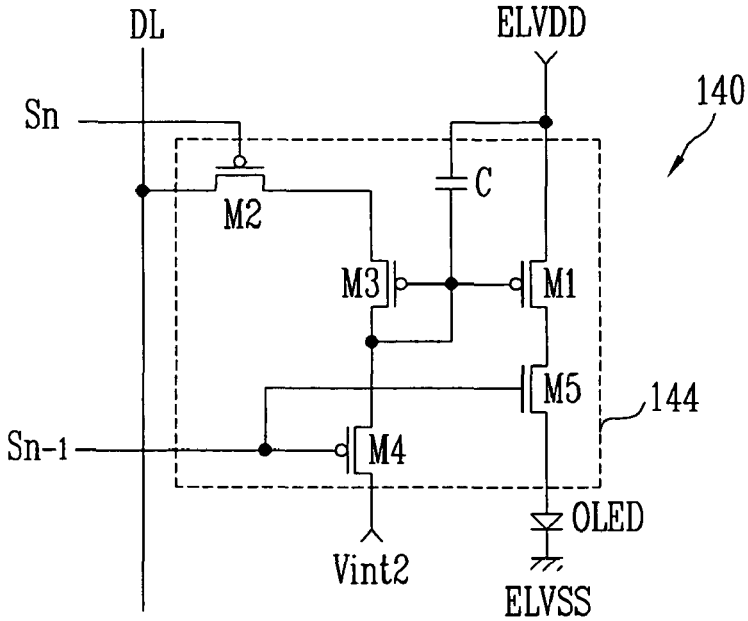
FIG. 7 is a circuitry diagram showing a second example of the pixel shown in FIG. 2.

FIG. 7 is a circuitry diagram showing a second example of the pixel shown in FIG. 2. A pixel 140 of FIG. 7 receives an initializing signal before the data signal is applied thereto. Furthermore, at least one transistor included in each of pixels 140 is connected to be able to be used as a diode.

With reference to FIG. 7, the pixels 140 according to the second embodiment of the invention each includes an organic light emitting diode OLED, and a pixel circuit 144. The pixel circuit 144 is connected to the second data line DL and the scan line Sn, and causes the organic light emitting diode OLED to emit light.

An anode electrode of the organic light emitting diode OLED is connected to the pixel circuit 144, and a cathode thereof is connected to a second power supply ELVSS. The second power supply ELVSS has a voltage lower than that of the first power supply ELVDD. For example, the voltage of the second power supply ELVSS may be a ground voltage. The organic light emitting diode OLED generates light corresponding to a current supplied from the pixel circuit 144.

The pixel circuit 144 includes a first transistor M1, a second transistor M2, a third transistor M3, a fourth transistor M4, a fifth transistor M5, and a storage capacitor C. The second transistor M2 is connected to the second data line DL and the n-th scan line Sn. The third transistor M3 and the fourth transistor M4 are connected between the second transistor M2 and a second initialization power supply Vint2. The first transistor M1 and the fifth transistor M5 are connected between the first power supply ELVDD and the organic light emitting diode OLED. The storage capacitor C is between a first electrode and a gate electrode of the first transistor M1. Although it shown in FIG. 7 that the first, second, third and fourth transistors M1, M2, M3, and M4 are of P-type MOSFETs, and the fifth transistor M5 is of an N-type MOSFET, the invention is not limited thereto. The fifth transistor M5 is formed by a MOSFET of a conductive type different from that of each of the first to fourth transistors M1 to M4.

A first electrode of the first transistor M1 is connected to the first power supply ELVDD, and a second electrode thereof is connected to a first electrode of the fifth transistor M5. Moreover, a gate of the first transistor M1 is connected to a gate electrode of the third transistor M3. The first transistor M1 provides an electric current corresponding to a voltage charged in the storage capacitor C to the organic light emitting diode OLED.

A second electrode of the fifth transistor M5 is connected to the organic light emitting diode OLED, and a gate electrode thereof is connected to the $(n-1)^{th}$ scan line Sn−1. When the scan signal is not supplied to the $(n-1)^{th}$ scan line Sn−1, the fifth transistor M5 is turned-on, thereby providing the electric current from the first transistor M1 to the organic light emitting diode OLED.

A gate electrode of the second transistor M2 is connected to the n-th scan line Sn, and a first electrode thereof is connected to the second data line DL. Further, a second electrode of the second transistor M2 is coupled with a first electrode of the third transistor M3. When the scan signal is supplied to the n-th scan line Sn, the second transistor M2 is turned-on, thereby providing the data signal supplied to the second data line DL to the third transistor M3.

A second electrode of the third transistor M3 is coupled with a first electrode of the fourth transistor M4. Moreover, the second electrode and the gate electrode of the third transistor M3 are electrically connected to each other so that the third transistor M3 may be used as a diode.

A gate electrode of the fourth transistor M4 is coupled with the (n−1) scan line Sn−1, and a second electrode thereof is coupled with a second initialization power supply Vint2. When the scan signal is supplied to the (n−1) scan line Sn−1, the fourth transistor M4 is turned-on, thereby providing a voltage of the second initialization power supply Vint2 to the third transistor M3.

Figure 8:
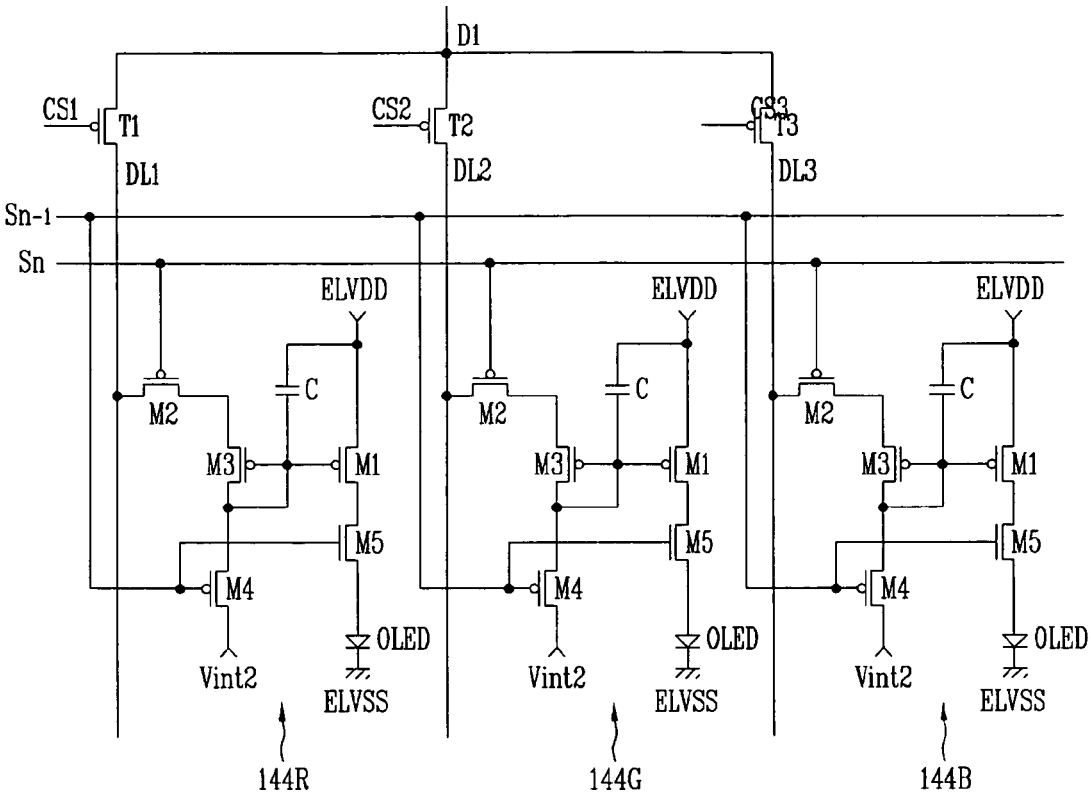
FIG. 8 is a circuitry diagram showing a connected example of the demultiplexer and the pixel shown in FIG. 3 and FIG. 7, respectively.
Figure 9:
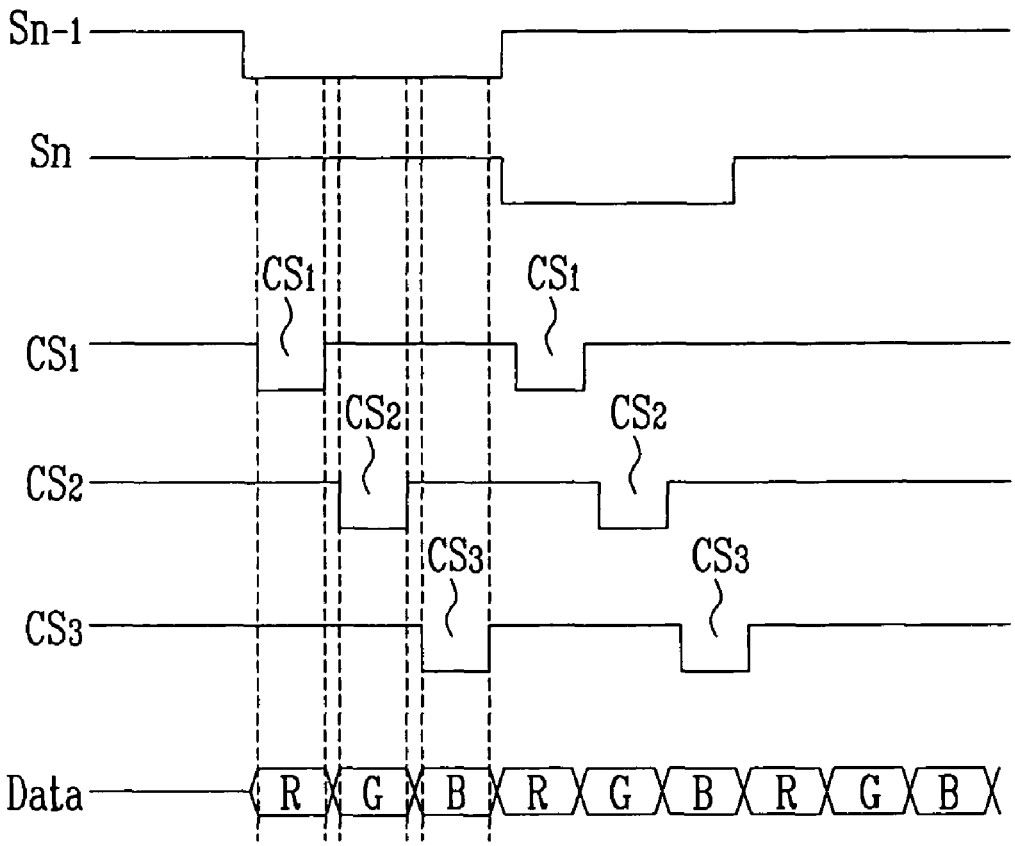
FIG. 9 is a waveform chart of signals that are supplied to the demultiplexer and the pixel shown in FIG. 8.

FIG. 8 is a circuitry diagram showing a connected example of the demulitplexer and the pixel shown in FIG. 3 and FIG. 7, respectively. Here, it is assumed that red (R), green (G), and blue (B) pixels are coupled with the demultiplexer 162 (namely, i=3). FIG. 9 is a waveform chart of signals that are supplied to the demulitplexer and the pixel shown in FIG. 8.

Referring to FIG. 8 and FIG. 9, when the scan signal is firstly supplied to the $(n-1)^{th}$ scan line Sn−1, fourth transistors M4 included in the pixels 144R, 144G, and 144B are turned-on. When the fourth transistors M4 are turned-on, one terminal of the storage capacitor C, a gate electrode of the first transistor M1, and a gate electrode of the third transistor M3 are all coupled with the second initialization power supply Vint2. That is, when the fourth transistor M4 is turned-on, a voltage of the second initialization power supply Vint2 is supplied to the one terminal of the storage capacitor C, the gate electrode of the first transistor M1, and the gate electrode of the third transistor M3. Here, the voltage of the second initialization power supply Vint2 is set lower than a voltage of the data signal. In practice, the voltage of the second initialization power supply Vint2 is set lower than a voltage obtained by subtracting a threshold voltage of the third transistor M3 from the lowest voltage of a data signal to be supplied from the data driver 120.

Next, the scan signal is provided to the n-th scan line Sn. When the scan signal is provide to the n-th scan line Sn, the second transistors M2 included in the pixels 144R, 144G, and 144B are all turned-on. After turning-on the second transistors M2 included in the pixels 144R, 144G, and 144B, the first switch T1 is turned-on by a first control signal CS1.

When the first switch T1 is turned-on, the data signal supplied to the first data line D1, is provided to a first electrode of the third transistor M3 included in the first pixel 144R via the first switch T1. At this time, since the gate electrode of the third transistor M3 has been initialized by the second initialization power supply Vint2 (that is, it has a voltage lower than that of the first electrode), the third transistor M3 is turned-on. When the third transistor M3 is turned-on, the data signal is provided to the gate electrode of the third transistor M3 and one terminal of the storage capacitor C. At this time, a voltage corresponding to the data signal and a threshold voltage of the third transistor M3 is charged in the storage capacitor C.

Thereafter, the first switch T1 is turned-off, but the second switch T2 and the third switch T3 are sequentially turned-on to sequentially supply the data signal to the second pixel 144G and the third pixel 144B.

That is, in the second embodiment of the invention, the data signal supplied to the first data line D1 may be supplied to the i second data lines DL by using a demultiplexer 162. However, the second embodiment of the invention has concern in which a desired data signal can not be supplied to the pixels 142.

In a detailed description, while the first switch T1 is being turned-on, as described previously, a voltage corresponding to the data signal is charged in the storage capacitor of the first pixel 144R. Here, during a turning-on period of the first switch T1, the second transistors M2 of the second pixel 144G and the third pixel 144B maintain a turning-on state by the scan signal supplied to the n-th scan line Sn.

When the second transistor M2 of the second pixel 144G maintains a turning-on state, gate electrode of the first transistor M1 and the third transistor M3 are electrically connected to the second data line DL2. Here, the second data line DL2 maintains a voltage value of the data signal supplied during a previous period (previous field or frame) by a parasitic capacitor and the like. Accordingly, a voltage value of each gate electrode of the first transistor M1 and the third transistor M3 is changed to a voltage value of the data signal supplied at the previous period. That is, the voltage value initialized by the second initialization power supply Vint2 is changed to a voltage value of the data signal supplied during the previous period.

Next, the second switch T2 is turned-on by the second control signal CS2. When the second switch T2 is turned-on, the data signal supplied to the first data line D1, is provided to the second data line DL2. The data signal provided to the second data line DL2, is supplied to a first electrode of the third transistor M3 via the second transistor M2 of the second pixel 144G. Here, a voltage value corresponding to a current data signal to a first electrode of the third transistor M3, whereas a voltage value corresponding to a previous data signal is a gate electrode thereof. In this case, when the voltage value of the current data signal is greater than a sum of a voltage value of the data signal and a threshold voltage of the third transistor M1, the third transistor M3 is turned-on. In remaining cases, the third transistor M3 is turned-off.

That is, when driving a demultiplexer 162 in the second embodiment of the invention, because voltage values of gate electrodes of the third transistors M3 included in the second pixel 144G and the third pixel 144B are changed, the data signal can not be supplied to pixels. This causes a desired image not to be displayed. In order to solve the problem, in the invention, an organic light emitting display shown in FIG. 10 is proposed.

Figure 10:
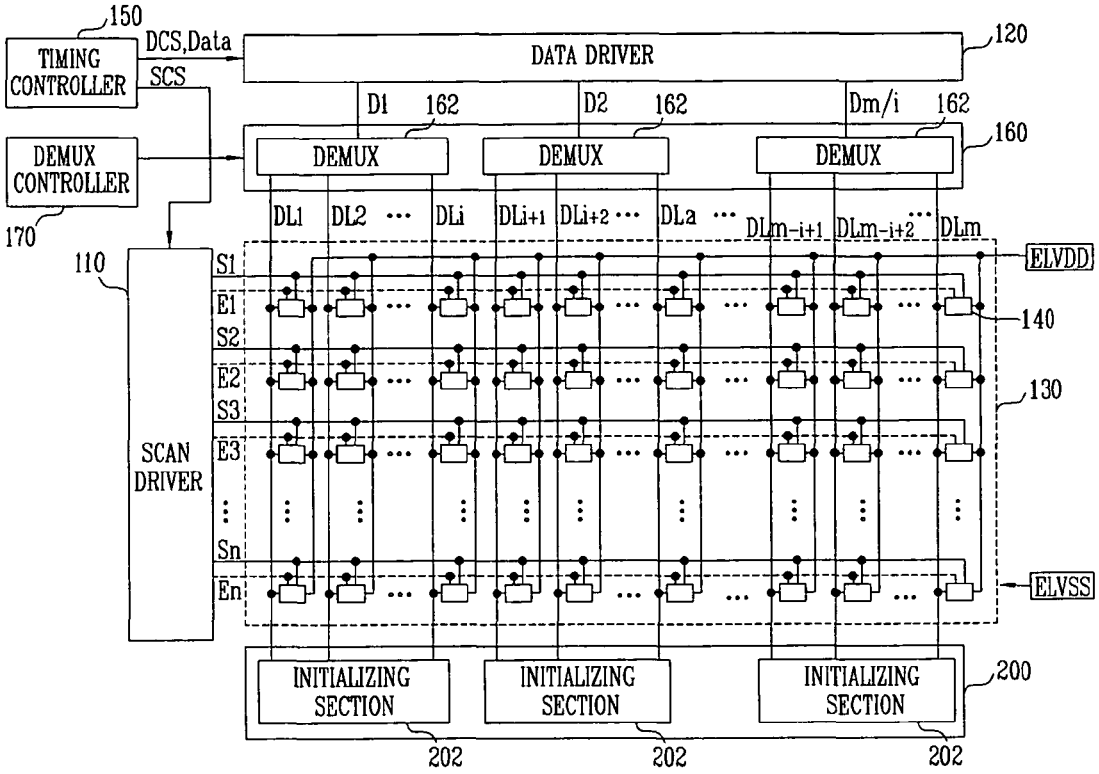
FIG. 10 is a view showing a organic light emitting display according to a second embodiment of the invention.

FIG. 10 is a view showing an organic light emitting display according to a second embodiment of the invention. The same constructions in FIG. 10 as those in FIG. 2 are omitted for clarity. Also, like reference numerals refer to like elements throughout.

With reference to FIG. 10, the organic light emitting display according to the second embodiment of the invention includes a scan driver 110, a data driver 120, a pixel portion 130, a timing controller 150, a demultiplexer block 160, a demultiplexer controller 170, and an initialization block 200.

The initialization block 200 includes a plurality of initializing sections 202 coupled with i second data lines DL. The initializing sections 202 supply a voltage of a first initialization power supply to each of the second data lines DL every horizontal period before the data signal is supplied.

Figure 11:
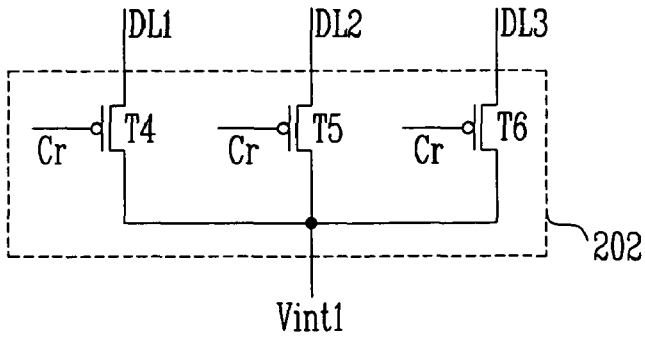
FIG. 11 is a view showing the initializing section shown in FIG. 10.

In order to do this, as shown in FIG. 11, the initializing sections 202 include i initialization switches T4, T5, and T6. It is assumed that 'i' is 3. The initialization switches T4, T5, and T6 are connected to a first initialization power supply Vint1 in common, and are connected to second data lines DL different from each other. The initialization switches T4, T5, and T6 are turned-on, avoiding being overlapped with turning-on times of data switches T1 to T3 included in the demultiplexer 162.

Figure 12:
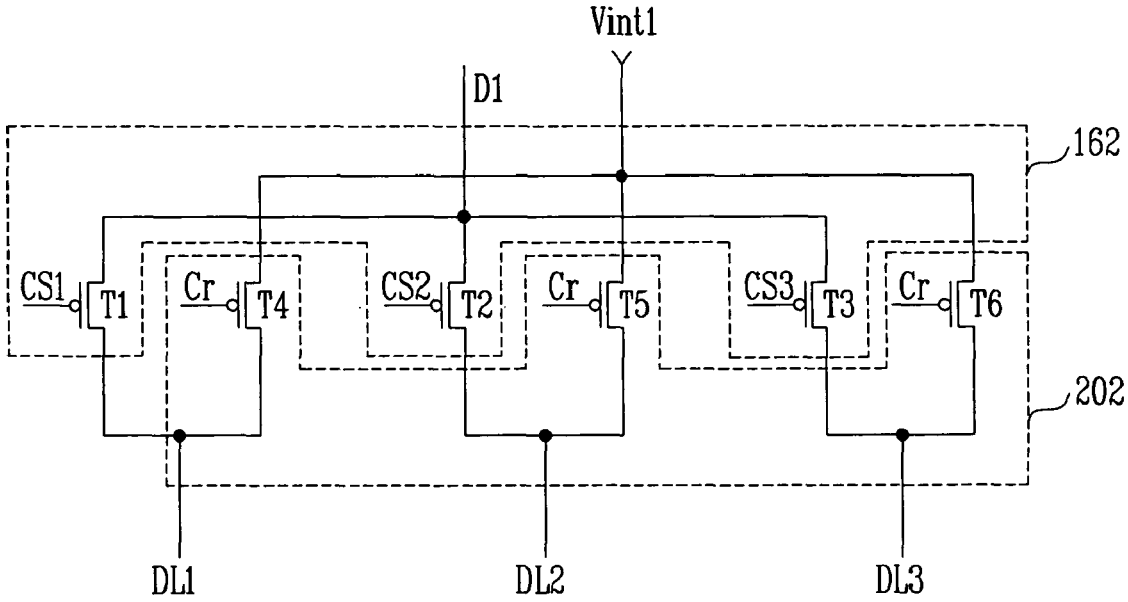
FIG. 12 is a view showing a state in which the initializing section shown in FIG. 10 is installed adjacent to a demultiplexer.

On the other hand, in the invention, as shown in FIG. 12, the initialization switches T4, T5, and T6 included in the initializing section 202 can be positioned to be adjacent to data switches T1 to T3 included in the demultiplexer 162. Here, the operations of the initialization switches T4, T5, and T6, positioned adjacent to the date switches T1 to T3, and the operations of the initialization switches T4, T5, and T6 are identical with each other. Then, in order to help understanding of the initialization switches T4, T5, and T6, it is assumed that the initialization switches T4, T5, and T6, are positioned adjacent to the data switches T1 to T3.

Figure 13:
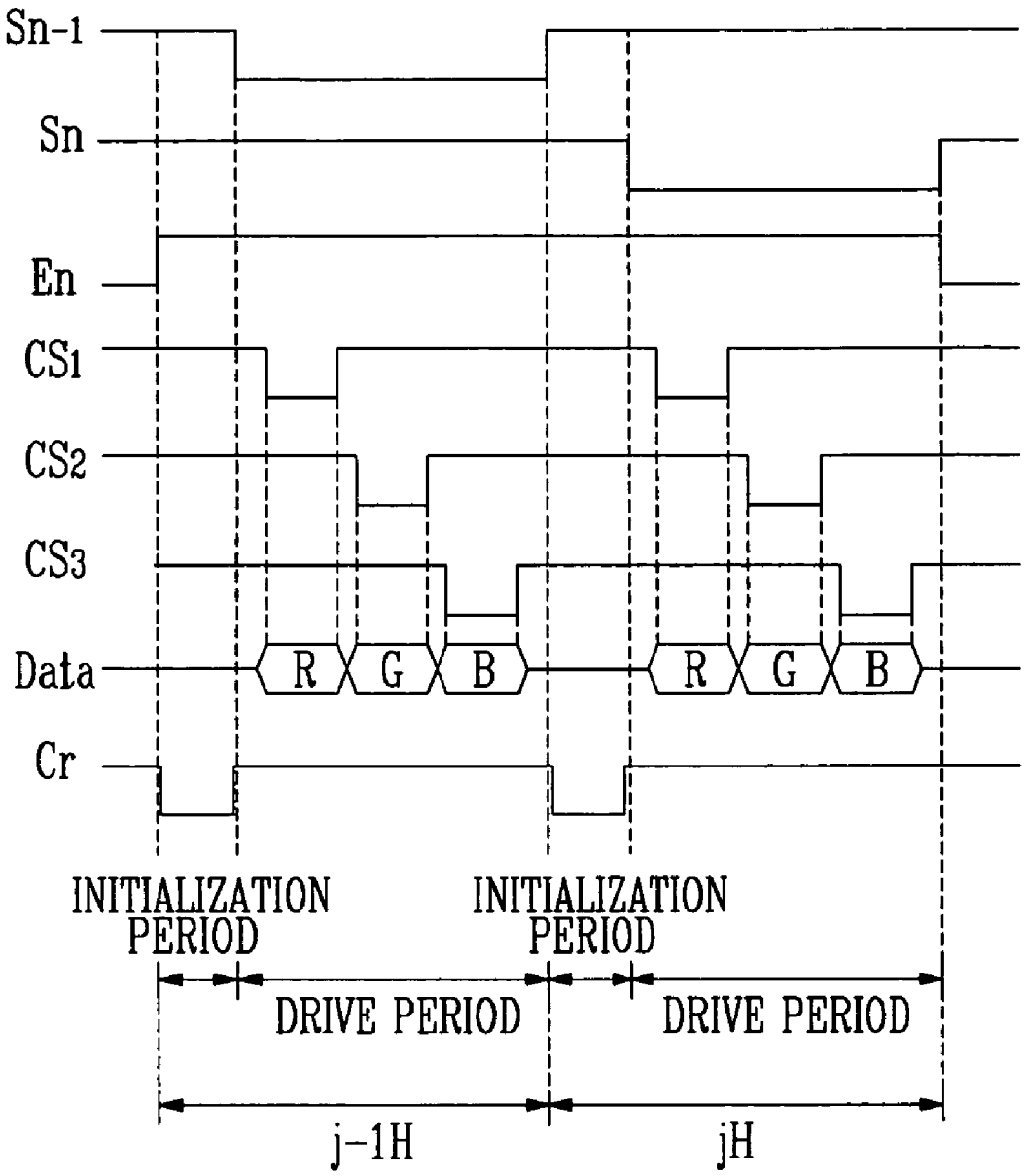
FIG. 13 is a waveform chart showing a first example of signals that are supplied to the organic light emitting display shown in FIG. 10.

The first initialization switch T4 is installed between the first initialization power supply Vint1 and the second data line DL1, and provides a voltage of the first initialization power supply Vint1 to the second data line DL1. Here, the voltage of the first initialization power supply Vint1 is set lower than the lowest voltage of a data signal to be supplied to the pixel portion 130. For example, if the lowest voltage supplied from the data driver 120 to the pixel portion 130 is 2V, the voltage of the first initialization power supply Vint1 is set lower than 2V. Substantially, the voltage of the first initialization power supply Vint1 is set lower than a voltage obtained by subtracting a threshold voltage of a transistor include in a pixel 140 from the lowest voltage of a data signal supplied to the pixel portion 130. As shown in FIG. 13, the first initialization switch T4 is turned-on according to an initialization signal Cr supplied from the demultiplexer controller 170.

The second initialization switch T5 is installed between the first initialization power supply Vint1 and the second data line DL2, and provides the voltage of the first initialization power supply Vint1 to the second data line DL2. As shown in FIG. 13, the second initialization switch T5 is turned-on according to an initialization signal Cr provided from the demultiplexer controller 170.

The third initialization switch T6 is installed between the first initialization power supply Vint1 and the second data line DL3, and provides the voltage of the first initialization power supply Vint1 to the second data line DL3. As shown in FIG. 13, the third initialization switch T6 is turned-on according to the initialization signal Cr provided from the demultiplexer controller 170.

FIG. 13 is a waveform chart showing a first example of signals that are supplied to the organic light emitting display shown in FIG. 10. Referring to FIG. 13, in the invention, one horizontal period 1H is divided into an initialization period (first period) and a drive period (second period). During the initialization period, the initialization signal Cr from the demultiplexer controller 170 is supplied to the initialization switches T4, T5, and T6. Accordingly, the initialization switches T4, T5, and T6 are turned-on to supply the first initialization power supply Vint1 to the second data lines DL. At this time, voltages of a parasitic capacitor, and the like, formed at the second data lines DL are changed to a voltage of the first initialization power supply Vint1.

During the drive period, the scan signal from the scan driver 110 is supplied to the scan line S. Further, during the drive period, i data signals R,G,B from the data driver 120 are supplied to the first data line D1. Simultaneously, i control signals CS1,CS2,CS3 from the demultiplexer controller 170 are sequentially supplied to the data switches T1 to T3. Accordingly, the data signals R,G,B supplied to a first data line D are provided to i second data lines DL.

Figure 14:
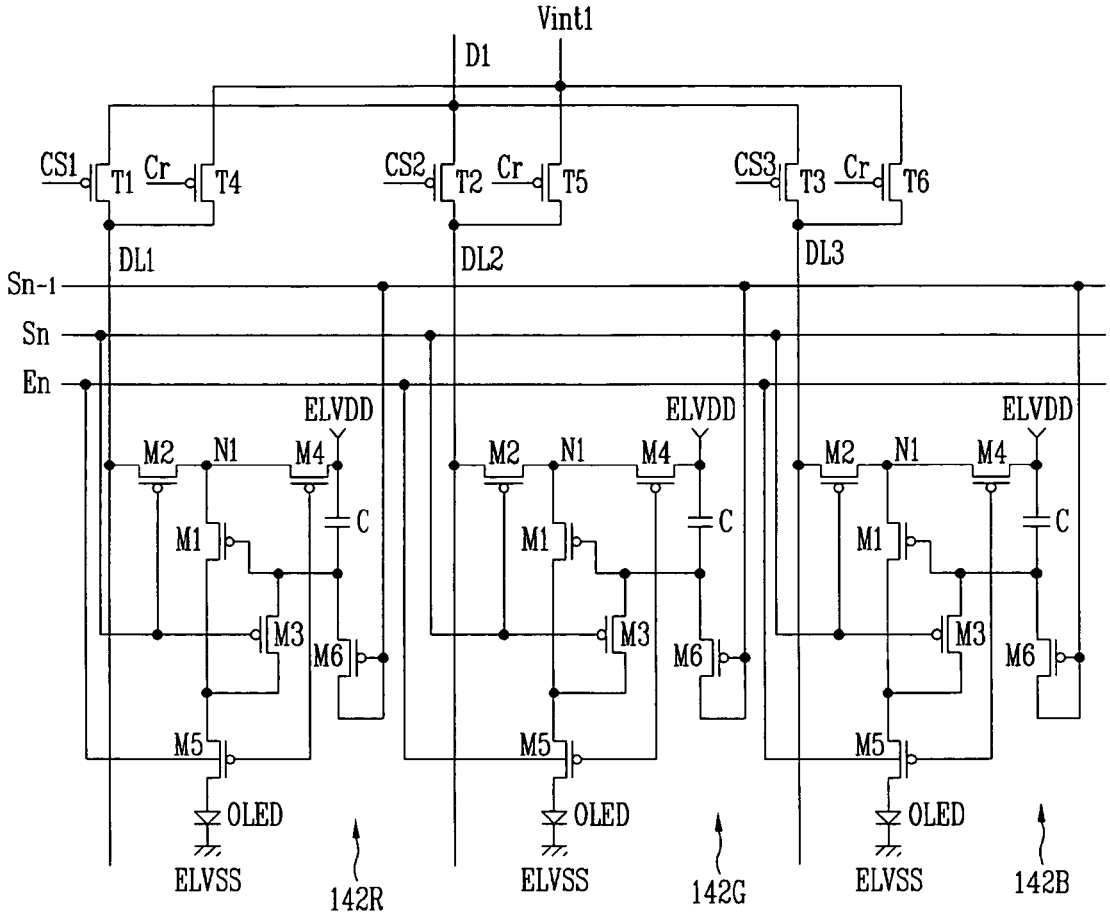
FIG. 14 is a circuitry diagram showing a structure to which the demultiplexer and the initializing section shown in FIG. 12 are connected the pixels shown in FIG. 2.

FIG. 14 is a circuitry diagram showing a structure to which the demultiplexer and the initializing section shown in FIG. 12 are connected the pixels shown in FIG. 2. In this example, the red (R), green (G), and blue (B) pixels are coupled with one demultiplexer (that is, i=3).

Referring to FIG. 13 and FIG. 14, during a drive period of $(j-1)^h$ horizontal period j−1H, the scan signal is supplied to the (n−1) scan line Sn−1 to turn on the sixth transistors M6 included in the respective pixels 142R, 142G, and 142B. When the sixth transistors M6 are turned-on, the storage capacitor C and a gate electrode of the first transistor M1 are electrically connected to the $(n-1)^{th}$ scan line Sn−1. Namely, when the sixth transistors M6 are turned-on, the scan signal is applied to the storage capacitor C and the gate electrode of the first transistor M1.

Thereafter, an initialization signal Cr is supplied to initialization switches T4, T5, and T6 for a initialization period of j-th horizontal period jH. When the initialization signal Cr is supplied to the initialization switches T4, T5, and T6, the initialization switches T4, T5, and T6 are all turned-on. When the initialization switches T4, T5, and T6 are turned-on, the second data lines DL1, DL2, and DL3 are electrically connected to the first initialization power supply Vint1. Accordingly, a voltage corresponding to a data signal of a previous frame (or previous field) stored in each parasitic capacitor of the second data lines DL1, DL2, and DL3 is changed to a voltage of the first initialization power supply Vint1.

Next, the scan signal is supplied to the n-th scan line Sn for a drive period of j-th horizontal period jH. When the scan signal is supplied to the n-th scan line Sn, the second transistor M2 and the third transistor M3 included in each of the pixels 142R, 142G, and 142B are turned-on. Accordingly, the first node N1 of the pixels 142R, 142G, and 142B is electrically connected to the second data lines DL1, DL2, and DL3, respectively. Here, since a voltage of the first initialization power supply Vint1 is set to each of the second data lines DL1, DL2, and DL3, the first transistor M1 is turned-on or turned-off. In practice, the turning-on or turning-off of the first transistor M1 is determined according to a voltage value of the first initialization power supply Vint1. Here, the voltage value of the first initialization power supply Vint1 is set lower than a voltage obtained by subtracting a threshold voltage of a transistor included in the pixel 140 from the lowest voltage of a data signal to be supplied to the pixel portion 130.

For example, when the first transistor M1 is turned-on, a voltage value of a gate electrode of the first transistor M1 is changed to the voltage value of the first initialization power supply Vint1. Further, when the first transistor M1 is turned-off, a voltage value of the gate electrode of the first transistor M1 maintains a voltage value of the scan signal.

On the other hand, the first control signal CS1, the second control signal CS2, and the third control signal CS3 are sequentially supplied for the drive period of the j-th horizontal period jH. When the first control signal CS1 is supplied, the first data switch T1 is turned-on, so that the data signal supplied to the first data line D1 is provided to the first node N1 of the first pixel 142R through the first data switch T1. When a voltage of the data signal is supplied, the first transistor M1 is turned-on. In other words, since a voltage value of the first initialization power supply Vint1 or the scan signal is set as a voltage of the gate electrode of the first transistor M1, the first transistor M1 is turned-on when the data signal is supplied to the first node N1. When the first transistor M1 is turned-on, the data signal supplied to the first node N1 is provided to one terminal of the storage capacitor C via the transistor M1 and the third transistor M3. At this time, a voltage corresponding to the data signal is charged in the storage capacitor C.

Next, the first data switch T1 is turned-off, but the second transistor T2 is turned-on according to the second control signal CS2. When the second data switch T2 is turned-on, the data signal supplied to the first data line D1 is provided to the first node N1 of the second pixel 142G through the second data switch T2. When the voltage of the data signal is supplied to the first node N1, the first transistor M1 is turned-on. In other words, because a voltage value of the first initialization power supply Vint1 or the scan signal is set as a voltage value of the gate electrode of the first transistor M1, the first transistor M1 is turned-on when the data signal is provided to the first node N1. When the first transistor M1 is turned-on, the data signal applied to the first node N1 is provided to one terminal of the storage capacitor C through the first transistor M1 and the third transistor M3. At this time, a voltage corresponding to the data is charged in the storage capacitor C.

Thereafter, the second data switch T2 is turned-off, but the third data switch T3 is turned-on according to the third control signal CS3. When the third data switch T3 is turned-on, the data signal supplied to the first data line D1 is provided to the first node N1 of the third pixel 142B via the third data switch T3. When a voltage of the data signal is supplied to the first node N1, the first transistor M1 is turned-on. In other words, because a voltage value of the first initialization power supply Vint1 or the scan signal is set as a voltage value of the gate electrode of the first transistor M1, the first transistor M1 is turned-on when the data signal is supplied to the first node N1. When the first transistor M1 is turned-on, the data signal applied to the first node N1 is provided to one terminal of the storage capacitor C through the first transistor M1 and the third transistor M3. At this time, a voltage corresponding to the data signal is charged in the storage capacitor C.

As described previously, the invention has an advantage that may provide the data signal supplied to the one first data line D1, to i second data lines DL using the demultiplexer 162. Furthermore, since the invention provides a voltage of the first initialization power supply Vint1 to the second data lines DL for an initialization period of one horizontal period, a desired image can be stably displayed.

Figure 15:
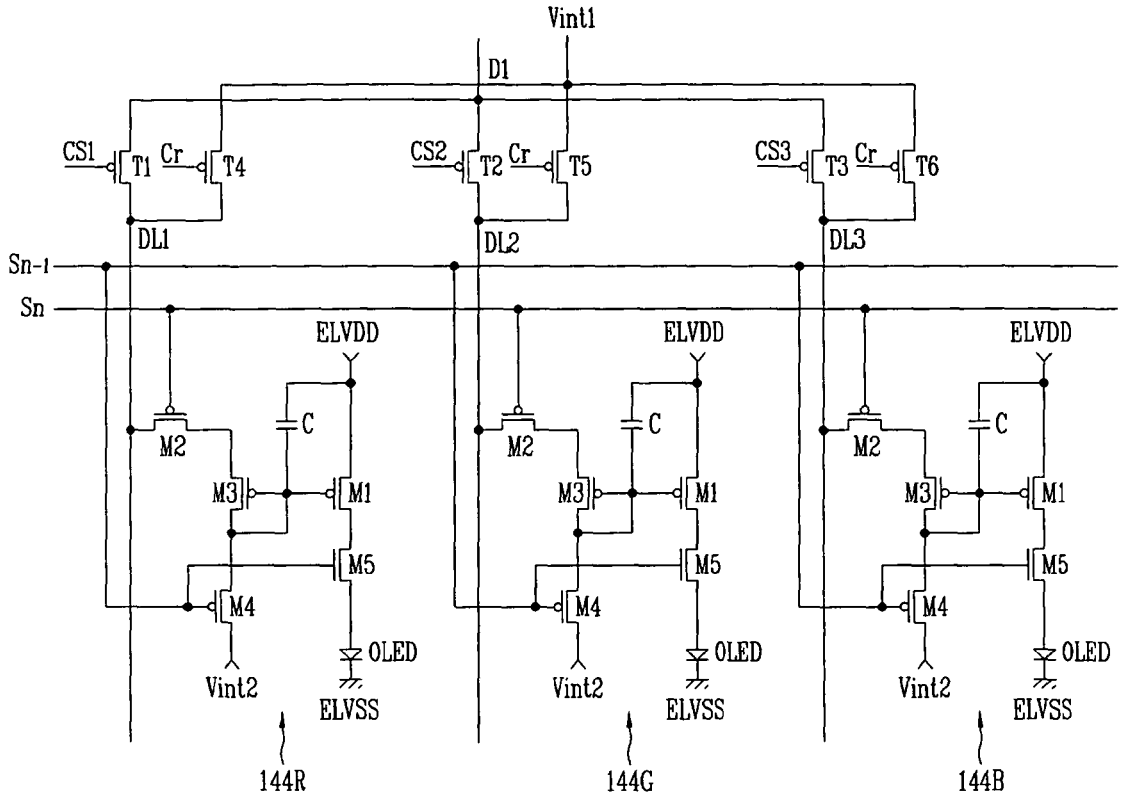
FIG. 15 is a circuitry diagram showing a structure to which the demultiplexer and the initializing section shown in FIG. 12 are connected the pixels shown in FIG. 7.

FIG. 15 is a circuitry diagram showing a structure to which the demultiplexer and the initializing section shown in FIG. 12 are connected the pixels shown in FIG. 7. Here, it is assumed for explanation purposes that red (R), green (G), and blue (B) pixels are coupled with one demultiplexer.

Hereinafter, the invention will be described by FIG. 15 in relation to FIG. 13. Here, it is assumed that drive waves of FIG. 13 supplied to a light emitting control line En, are not provided in FIG. 15.

Referring to FIG. 13 and FIG. 15, when the scan signal is supplied first to the $(n-1)^{th}$ scan line Sn−1 for a drive period of a (j−1)th horizontal period j−1H, the fourth transistors M4 included in each of the pixels 144R, 144G, and 144B are turned-on. When the fourth transistors M4 are turned-on, the second initialization power supply Vint2 is coupled with one terminal of the storage capacitor C, a gate electrode of the first transistor M1, and a gate electrode of the third transistor M3. That is, when the fourth transistor M4 is turned-on, a voltage of the second initialization power supply Vint2 is supplied to one terminal of the storage capacitor C, a gate electrode of the first transistor M1, and a gate electrode of the third transistor M3 to be initialized. Here, the voltage of the second initialization power supply Vint2 is set lower than a voltage obtained by subtracting a threshold voltage of the third transistor M3 from the lowest voltage of a data signal supplied from the data driver 120. On the other hand, voltage value of the first initialization power supply Vint1 and the second initialization power supply Vint2 may be set to be identical with or different from each other.

During an initialization period of a j-th horizontal period jH, an initialization signal Cr is supplied to initialization switches T4, T5, and T6. When the initialization signal Cr is supplied to initialization switches T4, T5, and T6, the initialization switches T4, T5, and T6 are turned-on. When the initialization switches T4, T5, and T6 are turned-on, the first initialization power supply Vint1 is electrically connected to the second data lines DL1, DL2, and DL3. Accordingly, a voltage corresponding to a data signal of a previous frame (or previous field) stored in each parasitic capacitor of the second data lines DL1, DL2, and DL3, is changed to a voltage of the first initialization power supply.

Thereafter, the scan signal is supplied to the n-th scan line Sn during a drive period of the j-th horizontal period jH. When the scan signal is supplied to the n-th scan line Sn, the second transistors M2 included in pixels 144R, 144G, and 144B are turned-on. Accordingly, a first electrode of the third transistor M3 included in each of the pixels 144R, 144G, and 144B is coupled with the second data lines DL1, DL2, and DL3. At this time, a voltage of a first electrode of the third transistor M3 is changed to a voltage of the first initialization power supply Vint1. When the voltage of the first initialization power supply Vint1 is provided to the first electrode of the third transistor M3, the first transistor M1 is turned-on or turned-off.

In practice, a turning-on and a turning-off of the third transistor M3 are determined according to a voltage value of the first initialization power supply Vint1. Here, when the third transistor M3 is turned-on, a voltage value of the gate electrode of the third transistor M3 is changed to the voltage value of the first initialization power supply Vint1. Further, when the third transistor M3 is turned-off, a voltage value of a gate electrode of the third transistor M3 maintains a voltage value of the second initialization power supply Vint2.

On the other hand, during a drive period of the j-th horizontal period jH, a first control signal CS1 to a third control signal CS3 are sequentially provided. When the first control signal CS1 is provided, the first data switch T1 is turned-on, so that the data signal supplied to the first primary data line D1 is provided to a first electrode of a third transistor M3 included in the first pixel 144R. At this time, the third transistor M3 is turned-on, thereby causing the data signal to be supplied to a gate electrode of the third transistor M3, namely, one terminal of the storage capacitor C. At this moment, a voltage corresponding to the data signal is charged in the storage capacitor C.

Next, the first data switch T1 is turned-off, but the second data switch T2 is turned-on according to the second control signal CS2. When the second data switch T2 is turned-on, the data signal supplied to the first data line D1 is provided to a first electrode of the third transistor M3 included in the second pixel 144G. At this moment, because a gate electrode of the third transistor M3 is initialized by the first initialization power supply Vint1 or the second initialization power supply Vint2, the third transistor M3 is turned-on. When the third transistor M3 is turned-on, the data signal is supplied to one terminal of the storage capacitor C, thereby causing a voltage corresponding to the data signal to be charged in the storage capacitor C.

Thereafter, the second data switch T2 is turned-off, but the third data switch T3 is turned-on according to a third control signal CS3. When the third data switch T3 is turned-on, a data signal supplied to a first data line D1 is provided to a first electrode of the third transistor M3 included in the third pixel 144B. At this time, since a gate electrode of the third transistor M3 is initialized by the first initialization power supply Vint1 or the second initialization power supply Vint2, the third transistor M3 is turned-on. When the third transistor M3 is turned-on, a data signal is provided to one terminal of the storage capacitor C, thereby causing a voltage corresponding to the data signal to be charged in the storage capacitor C.

As described above, the invention has an advantage that allows a data signal supplied to one first data line D to be provided to i second data lines DL using a demultiplexer 162. Moreover, since the invention supplies a voltage of the first initialization power supply Vint1 to the second data lines DL during an initialization period of one horizontal period, it can stably display a desired image.

Figure 16:
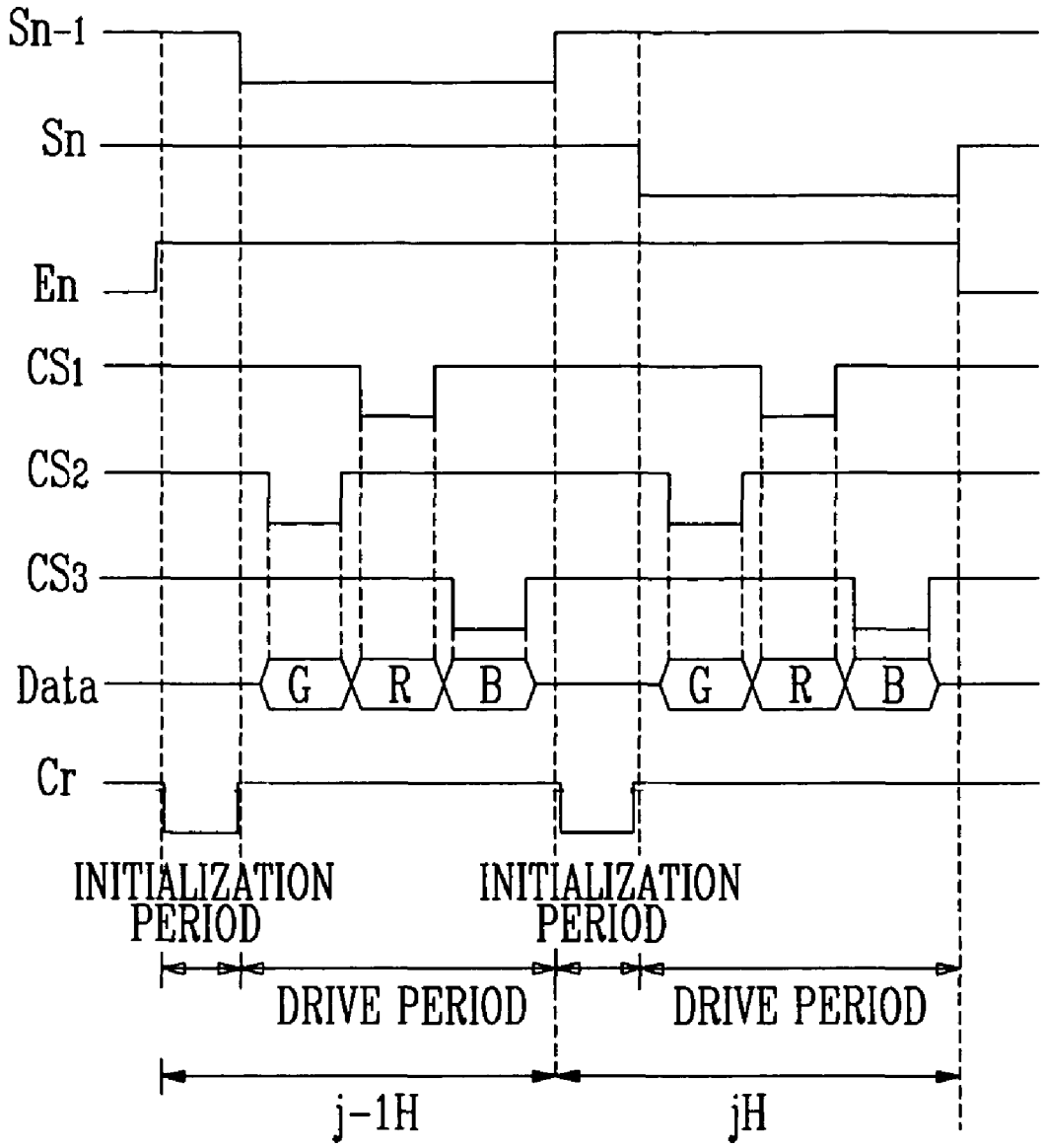
FIG. 16 is a waveform chart showing a second example of signals that are supplied to the organic light emitting display shown in FIG. 10.

On the other hand, while the scan signal is being supplied, a higher current from a pixel 140 receiving the data signal after a pixel 140 firstly receiving the data signal, is applied to the organic light emitting diode OLED. As a result, the invention may set an applied order of the first to third control signals CS1 to CS3 as shown in FIG. 16, in consideration of light emitting efficiency of the organic light emitting diode OLED. In this example, it is assumed that respective demultiplexers 162 are connected to red (R), green (G), and blue (G) pixels, respectively.

In a detailed description, during a supply period of the scan signal, a voltage corresponding to a data signal is first charged in the storage capacitor C of the pixel 140 receiving the data signal. However, since the data signal is not supplied to the storage capacitor C of the pixel 140 receiving the data signal later, a voltage higher than a desired voltage is charged therein. Namely, although a data signal having the same gray scale value is supplied, a higher current is supplied to a organic light emitting diode OLED in the pixel 140 receiving the data signal later.

On the other hand, in general, light emitting efficiency of the organic light emitting diode OLED is in an order of a green (G) organic light emitting diode OLED, a red (R) organic light emitting diode OLED, and a blue (B) organic light emitting diode OLED. Accordingly, in the invention, as shown in FIG. 16, so as to first supply the data signal to the green (G) organic light emitting diode OLED having the highest light emitting efficiency, the second control signal CS2 is supplied first. In order to finally supply the data signal to the blue (B) organic light emitting diode OLED having the lowest light emitting efficiency, the third control signal CS3 is supplied last. Accordingly, when a data signal having the same gray scale value is supplied, the lowest current is supplied to the green (G) organic light emitting diode OLED having the highest light emitting efficiency, and the highest current is supplied to the blue (B) organic light emitting diode OLED having the lowest light emitting efficiency. That is, in the invention, a supply order of the first to third control signals CS1 to CS3 is controlled in consideration of light emitting efficiency of the organic light emitting diode OLED. This ordering allows an image having improved white balance to be displayed.

Although a few embodiments of the invention have been shown and described, it would be appreciated by those skilled in the art that changes might be made in this embodiment without departing from the principles and spirit of the invention, the scope of which is defined in the claims and their equivalents.

As mentioned above, in accordance with a organic light emitting display and a driving method thereof of the invention, since a data signal supplied to one output line is provided to i data lines, the number of output lines can be reduced, thereby causing manufacturing costs to be reduced. Furthermore, because a voltage of a second data line is set lower than a voltage of a data signal before the data signal is supplied to each of pixels, a stable image may be displayed. In addition, since the invention controls turning-on timing of transistors included in a demultiplexer in consideration of the light emitting efficiency of an organic light emitting diode employed, an image of more improved quality can be displayed.

What is claimed is:

1. A organic light emitting display comprising:

a scan driver for supplying a scan signal to a scan line during a second period of one horizontal period;

a data driver including a plurality of output lines, for supplying a plurality of data signals to the respective output lines during the second period;

demultiplexers installed at the respective output lines, and including a plurality of data transistors for supplying the data signals to a plurality of data lines during the second period;

initializing sections installed between a first initialization power supply and the plurality of data lines, and including a plurality of initialization transistors for supplying a voltage of the first initialization power supply to the plurality of data lines; and a pixel portion including a plurality of pixels positioned at areas partitioned by the scan line and the data lines, wherein the initialization transistors are turned-on during a first period of the one horizontal period, which is not overlapped with the second period, wherein the pixels each include:

an organic light emitting diode;

a first transistor for controlling a current supplied to the organic light emitting diode according to a first data signal;

a storage capacitor coupled with the first transistor for charging a voltage corresponding to the first data signal;

a second transistor coupled with an n-th scan line and an m-th data line, for transferring the first data signal supplied to the m-th data line to the storage capacitor;

a third transistor coupled between the first transistor and the second transistor, a gate and a second electrode of the third transistor being electrically connected to each other;

a fourth transistor coupled with the third transistor and a second initialization power supply, and being controlled by a scan signal supplied to an n−1 th scan line; and a fifth transistor coupled with the organic light emitting diode and the first transistor, and being controlled by the scan signal supplied to the n−1 th scan line.

2. The organic light emitting display as claimed in claim 1, wherein the initialization transistors are turned-on before the scan signal is supplied.

3. The organic light emitting display as claimed in claim 1, wherein at least one of the transistors of the pixels is coupled to be used as a diode.

4. The organic light emitting display as claimed in claim 1, further comprising a demultiplexer controller for an initializing a signal in order to turn-on the initialization transistors during the first period, and for supplying a plurality of control signals in order to sequentially turn-on the plurality of data transistors for during the second period.

5. The organic light emitting display as claimed in claim 1, wherein the voltage of the first initialization power supply is set to be lower than a voltage of the data signals.

6. The organic light emitting display as claimed in claim 5, wherein a voltage of the second initialization power supply is set to be lower than a voltage of the data signals.

7. The organic light emitting display as claimed in claim 1, wherein the fifth transistor is formed by a conductive type different from that of the fourth transistor.

8. The organic light emitting display as claimed in claim 1, wherein each of the demultiplexers is coupled with three data lines, and the three data lines are respectively coupled with red, green, and blue pixels having red, green, and blue organic light emitting diodes, respectively.

9. The organic light emitting display as claimed in claim 8, wherein a turning-on order of the data transistors is controlled so that the data signals are supplied first to a organic light emitting diode having the highest light emitting efficiency among the red, green, and blue organic light emitting diodes.

10. The organic light emitting display as claimed in claim 9, wherein the turning-on order of the data transistors is set so that a data signal is supplied to the green organic light emitting diode before a data signal is supplied to the blue organic light emitting diode.

* * * * *